United States Patent [19]

Dawes et al.

[11] Patent Number: 4,793,871

[45] Date of Patent: Dec. 27, 1988

[54] METHOD OF IMPROVING SURFACE WEAR QUALITIES OF METAL COMPONENTS

[75] Inventors: Cyril Dawes, West Midlands; Donald F. Tranter, Worcestershire, both of England

[73] Assignee: Lucas Industries Public Limited Company, Birmingham, England

[21] Appl. No.: 37,192

[22] Filed: Apr. 10, 1987

[30] Foreign Application Priority Data

Apr. 10, 1986 [GB] United Kingdom ..... 8608717

[51] Int. Cl.[4] ..... C21D 1/74

[52] U.S. Cl. ..... 148/16.5; 148/16.6

[58] Field of Search ..... 148/16, 16.5, 16.6, 148/16.7, 134, 14, 316–318

[56] References Cited

U.S. PATENT DOCUMENTS

| | | | |
|---|---|---|---|
| 3,892,597 | 1/1975 | Lincoln et al. | 148/16.6 |
| 4,016,013 | 4/1977 | Bitzer et al. | 148/16.5 |
| 4,049,472 | 9/1977 | Ardnt | 148/16 |
| 4,049,473 | 9/1977 | Davis, II et al. | 148/16.5 |
| 4,071,382 | 1/1978 | Riopelle | 148/126 |
| 4,160,680 | 7/1979 | Novy et al. | 148/16.5 |

FOREIGN PATENT DOCUMENTS

| | | |
|---|---|---|
| 0158271 | 10/1988 | European Pat. Off. . |
| 2332336 | 6/1977 | France . |
| 427073 | 6/1967 | Switzerland . |

OTHER PUBLICATIONS

Making Shaping and Treating, ed. McGannon, p. 1106, ©1971.

Metals Handbook, vol. 4, Heat Treating, pp. 194–196, 213–217.

Chemical Abstracts, vol. 100, p. 241, Abstract 160469W.

Chemical Abstracts, vol. 95, p. 235, Abstract 119237J.

Patent Abstract JP60165370.

Chemical Abstracts, vol. 89, p. 300, Abstract 134319.

Chemical Abstracts, vol. 101, p. 266, Abstract 95404A.

Dawes et al, "Nitriding Non-Alloy Steel Components", *Heat Treatment Metals*, 1980.1, pp. 1 through 4.

*Primary Examiner*—Christopher W. Brody

*Attorney, Agent, or Firm*—Nixon & Vanderhye

[57] ABSTRACT

A method is disclosed for subjecting a steel component made of a non-alloy or fine grained steel to a hardening treatment. An epsilon iron nitride surface layer of high surface area resistance is formed on the steel component by gas nitriding or nitrocarburizing and includes the preliminary step of heating the component to the nitriding temperature in an atmosphere which is inert to the metal of the component.

13 Claims, No Drawings

METHOD OF IMPROVING SURFACE WEAR QUALITIES OF METAL COMPONENTS

The invention relates to a metal component having improved surface wear qualities.

It is known to subject a metal component to nitriding or nitrocarburising in order to improve wear, frettage, seizure resistance and similar properties by forming an iron nitride layer such as an epsilon iron nitride layer. Typically the process is performed by placing the component in a heat treatment vessel in a gaseous atmosphere e.g. an ammonia atmosphere which is activated by an oxygen radical. The component must first be brought to a temperature at which the nitriding or nitrocarburising reaction will take place, typically 570° C. In practice, the component is placed in a vessel containing the treatment atmosphere which contains some oxygen radicals and is brought to the treatment temperature. The oxygen present will form an oxide layer on the component during the heating up period. Indeed some techniques recommend the deliberate formation of such an oxide layer by holding the component at an interim temperature, say 300° C., for a period before the heated component is exposed to the treatment atmosphere. For example, it is known to nitrocarburise components in a continuous furnace including the step of passing trays loaded with the components through a prewash machine and through an oxidation furnace where they are heated to 350° C. After heating to process temperature the loads are nitrocarburised and quenched or cooled, washed and unloaded. The importance of the oxidising treatment before nitrocarburising to ensure the uniformity of the nitrocarburised product is discussed in Problems of Kinetics and nucleation in gas nitriding, Hoffman, Schmaderer and Wahl, *Hart. Techn. Mitt,* 1983, Vol. 38, No. 3, pages 103 to 108. It has been observed that in some situations the surface layer is friable and may have a tendency to exfoliation. Under extreme conditions of wear abrasive surface particles are released and can do harm. For example, where two components are brought together the released particles trapped inbetween may cause severe wear and scoring on the opposed surfaces and loss of friction resistance.

Another technique of nitriding is known as the glow discharge or plasma nitriding process. In this process the components to be treated are charged into an airtight chamber, which constitutes the anode. The charge of components to be treated is placed in electrical contact with a cathode, e.g. a bottom plate on the floor of the chamber. The chamber is evacuated and then filled with the process gas which comprises nitrogen and may contain say hydrogen and methane. When the electrical charge is applied, the gas is ionized and the released positive nitrogen ions have a high kinetic energy and bombard the components to heat up the component and perform the nitriding. The gas thus serves both as the source of ions for the nitriding and nitrocarburising, and also as the heating medium.

It has now been discovered, and this is the basis of the invention, that by the deliberate exclusion of reactive elements from the atmosphere in which a steel component is raised to a treatment temperature for gaseous nitriding, most preferably in a vessel especially suited for the purpose, the component is given an especially enhanced surface wear resistance.

According to one aspect of the invention there is provided a method of subjecting a steel component to a surface hardening treatment to increase the wear resistance thereof, comprising heating the component to a treatment temperature and then exposing the heated component to a nitriding or nitrocarburising gaseous atmosphere characterised in that the heating of the component is carried out in an atmosphere which is inert with respect to the metal of the component the nitriding of nitrocarburising is carried out by contacting the heated component with nitrogen-containing gas or a mixture of gases containing nitrogen, oxygen and carbon, and heating the gases to a temperature to release the nitrogen or nitrogen and carbon from the gases to enter the component to form a surface layer of iron nitride having high wear resistance and hardness.

By the term inert atmosphere is meant one which is unreactive to the steel component. The presence of oxygen is to be avoided, since otherwise an oxide layer will be formed. The presence of ammonia in the heating atmosphere can be detrimental since that may react with the steel component in advance of the nitriding or nitrocarburising and ammonia is therefore also to be avoided. It is therefore a feature of the invention that the steel component be heated in an inert atmosphere such as nitrogen or argon or in vacuum. While the method can be practised in any suitable sealable retort or heat treatment furnace, it is a much preferred feature of the invention that the method be performed in a sealable metal retort because it is relatively easy to control the atmosphere therein.

According to a more specific aspect of the invention there is provided a method of improving the surface wear resistance of a steel component by subjecting the component to a nitriding or nitrocarburising treatment to form a iron nitride compound layer, the method comprising placing the component in a treatment vessel, heating the steel component to the treatment temperature followed by exposing the heated component to a nitriding or nitrocarnurising atmosphere characterised in that the steel component to be treated is placed in a sealed metal retort at ambient temperature, an inert atmosphere is introduced therein, the steel component is heated in the inert atmosphere to the treatment temperature, the inert atmosphere is removed and replaced by the treatment nitriding or nitrocarburising gaseous atmosphere, and the steel component is held in contact with the treatment atmosphere at sufficient temperature and for sufficient time to form an iron nitride compound layer.

The sealable metal retort is preferably a sealable vacuum metal retort fitted with an atmosphere circulation fan. Preferably the components in the retort are heated by forced convective heating by the fan. The retort is preferably mounted in a furnace and externally heated and cooled or it may be cooled by removal from the furnace. Preferably the retort is fitted with valved conduits so that the atmosphere therein may be changed by flushing out or by vacuum.

The nitriding or nitrocarburising gaseous atmosphere may be made up of ammonia with an addition of carbon dioxide, carbon monoxide, water vapour, air or oxygen or a gas mixture of endothermic gas or exothermic gas. The content of oxygen may be up to about 3% by volume. The treatment is preferably carried out at atmospheric pressure and at a temperature range of from about 540° C. to about 740° C., preferably at about 610° C. so that the gas is thermally cracked to provide the nitrogen for nitriding.

By virtue of the method, an iron nitride compound layer is formed at the surface of the component and extending beneath. The layer is substantially non-porous, and has a high degree of hardness, typically having a peak hardness of about 800 to about 1000 HV (under 25g load) at the extreme surface of the component. In addition the hardness is generally uniform throughout the depth of the layer. In contrast, the usual nitrocarburising produces peak hardness of from about 450 HV to 600 HV. As a result of the invention, the component has enhanced surface wear resistance.

The component is preferably of a non-alloyed steel or fine grained structural steel containing niobium and vanadium or titanium. The component may range from about 0.4 to about 5 mm in thickness. A typical component is a clutch plate or friction control plate for a viscous slip differential system. Components for this purpose tend to be from about 60 mm to about 250 mm in diameter.

The invention includes a component treated by the method and characterised by the presence of an iron nitride compound layer which is substantially non-porous and has a high degree of hardness at the outer surface.

The treated component may be given subsequent treatments such as cooling in an inert atmosphere, oxidation and quenching into oil or in water/oil emulsion.

In order that the invention may be well understood it will now be described with reference to the following example.

EXAMPLE

Clutch plates formed of non-alloyed steel were loaded into a hot wall sealed retort having chromium nickel steel walls. The retort was fitted in a hot wall vacuum furnace. The retort contained an atmosphere circulation fan. The plates were loaded at room temperature, following which the door was clamped shut. The retort was evacuated to $10^{-1}$m bar and then backfilled to atmospheric pressure with nitrogen. The temperature was then raised to 610° C. when that temperature had been reached, the retort was evacuated to $10^{-1}$m bar, and back filled with a treatment atmosphere comprising ammonia with 5% by volumn of CO2. The nitrocarburising was carried out for one hour, the atmosphere being changed twice. The retort was then evacuated to $10^{-1}$m bar, and backfilled with nitrogen. The retort was fast cooled to 200° C. and then unloaded.

The nitrocarburised components were evaluated. The surface porosity was found to be 0% and the surface hardness was 960 HV. The iron nitride compound layer was 18 micron deep. The components were subjected to a wear test and excellent results were obtained. In comparison with a control test in which the components were heated in air before nitrocarburising, a dramatic improvement in wear resistance was noted.

The invention is not limited to the method of the Example. For instance the method may be performed in other apparatus such as sealed quench batch or continous furnaces, preferably of multichamber construction.

We claim:

1. A method of subjecting a steel component made of a non-alloy or fine grained steel to a hardening treatment to increase the surface wear resistance thereof, comprising the steps of:

(a) disposing the component in a sealable vessel;

(b) deliberately excluding from the atmosphere in the vessel all elements in gaseous form which will cause the formation of a porous epsilon iron nitride layer thereon;

(c) heating the component in the vessel to a treatment temperature; and then (d) exposing the component, heated to the treatment temperature at atmospheric pressure, to a gaseous nitriding or nitrocarburizing atmosphere for a period until there is formed thereon an epsilon iron nitride layer which is wear resistant, has a hardness of about 800 to 1000 HV, is non porous, and extends 18 micron deep.

2. A method as recited in claim 1 wherein steps (b) and (c) are practiced by drawing a vacuum in the vessel and heating the component to the treatment temperature while the vacuum is maintained.

3. A method as recited in claim 1 wherein steps (b) and (c) are practiced by supplying a gaseous atmosphere which is inert to the steel component to the vessel, and heating the component to the treatment temperature in the inert gaseous atmosphere.

4. A method as recited in claim 1 wherein the steel component is formed of a non-alloy steel or fine grained structural steel containing niobium and vanadium or titanium.

5. A method as recited in claim 3 wherein the inert gas forming the inert gaseous atmosphere is selected from the group consisting essentially of nitrogen and argon.

6. A method as recited in claim 1 wherein steps (a) through (c) are practiced utilizing a sealable metal retort fitted with an atmosphere circulation fan as the sealable vessel.

7. A method as recited in claim 6 wherein step (c) is practiced by forced convective heating utilizing the fan of the sealable metal retort.

8. A method according to claim 6 wherein the method is practiced by mounting the retort in a vacuum furnace.

9. A method as recited in claim 1 wherein step (d) is practiced by supplying as the nitriding or nitrocarburising gaseous atmosphere gases selected from the group consisting essentially of: ammonia with an addition of carbon monoxide, water vapor, air or oxygen; and a gaseous mixture of endothermic gas; and a gaseous mixture of exothermic gas.

10. A method as recited in claim 2, wherein step (b) is practiced by drawing a vacuum in the vessel to about $10^{-1}$m bar, the vessel is then filled to atmospheric pressure with nitrogen and then step (c) is practiced while the component is in the nitrogen atmosphere.

11. A method as recited in claim 9 wherein step (d) is practiced at a temperature of from about 540° C. to about 740° C.,

12. A method as recited in claim 11, wherein the treatment temperature is about 610° C.

13. A method as recited in claim 11 wherein step (d) is practiced for about one hour.

* * * * *